US006951445B2

(12) United States Patent
Burgess

(10) Patent No.: US 6,951,445 B2
(45) Date of Patent: Oct. 4, 2005

(54) APPARATUS FOR USE IN SLURRY PUMPS

(75) Inventor: Kevin Edward Burgess, Carlingford (AU)

(73) Assignee: Weir Warman Ltd, Artarmoni (AU)

( * ) Notice: Subject to any disclaimer, the term of this patent is extended or adjusted under 35 U.S.C. 154(b) by 0 days.

(21) Appl. No.: 10/479,626

(22) PCT Filed: Jun. 7, 2002

(86) PCT No.: PCT/AU02/00734

§ 371 (c)(1),
(2), (4) Date: Dec. 4, 2003

(87) PCT Pub. No.: WO02/101245

PCT Pub. Date: Dec. 19, 2002

(65) Prior Publication Data

US 2004/0146416 A1 Jul. 29, 2004

(30) Foreign Application Priority Data

Jun. 13, 2001 (AU) ..... PR5645

(51) Int. Cl.[7] ..... F04D 29/70

(52) U.S. Cl. ..... 415/121.1; 415/198.1; 415/205; 415/206; 416/198 R; 416/223 R

(58) Field of Search ..... 415/121.1, 121.2, 415/205, 216.1, 198.1, 206; 416/175, 198 R, 223 R

(56) References Cited

U.S. PATENT DOCUMENTS

| | | | | |
|---|---|---|---|---|
| 478,307 A | | 7/1892 | Bee | |
| 2,371,681 A | | 3/1945 | Durdin, Jr. | 103/111 |
| 2,496,359 A | | 2/1950 | Ryman | 103/89 |
| 2,658,453 A | | 11/1953 | Walters | 103/104 |
| 2,714,354 A | | 8/1955 | Farrand | 103/111 |
| 3,067,960 A | * | 12/1962 | Neidl | 241/245 |
| 3,128,051 A | | 4/1964 | Smith | 241/69 |
| 3,155,046 A | | 11/1964 | Vaughan | 103/103 |
| 3,155,330 A | | 11/1964 | Holz et al. | 241/258 |

(Continued)

FOREIGN PATENT DOCUMENTS

| | | |
|---|---|---|
| AU | 452972 | 9/1974 |
| AU | 57351/99 | 5/2002 |
| DE | 254874 | 1/1912 |
| DE | 3340295 | 5/1985 |
| DE | 8526769.4 | 12/1985 |
| DE | 195 39 564 | 6/1996 |
| EP | 0 330 387 | 8/1989 |
| EP | 0 233 859 | 10/1990 |
| FR | 1323707 | 4/1963 |
| GB | 584395 | 1/1947 |
| GB | 1531025 | 11/1978 |
| GB | 1551918 | 9/1979 |
| GB | 1551919 | 9/1979 |
| SU | 985435 | 12/1982 |
| WO | WO 96/04467 | 2/1996 |
| WO | WO 00/05505 | 7/1999 |

*Primary Examiner*—Ninh H. Nguyen
(74) *Attorney, Agent, or Firm*—Steptoe & Johnson LLP

(57) ABSTRACT

Apparatus for use with a slurry pump, including a stationary part which includes a processing chamber having an inner side wall and a central axis, an inlet and an outlet to and from the processing chamber and a rotatable part at least partially disposed within the processing chamber and including an outer wall which is spaced from the inner wall of the processing chamber.

12 Claims, 3 Drawing Sheets

U.S. PATENT DOCUMENTS

| | | | | |
|---|---|---|---|---|
| 3,325,107 | A | 6/1967 | Peterson | 241/101 |
| 3,340,812 | A | 9/1967 | Schlesiger | 103/103 |
| 3,444,818 | A | 5/1969 | Sutton | 103/111 |
| 3,866,841 | A | 2/1975 | Iwahara | 241/46.11 |
| 3,973,866 | A | 8/1976 | Vaughan | 415/121 B |
| 4,145,008 | A | 3/1979 | Wolford | 241/46.17 |
| 4,430,214 | A | 2/1984 | Baker | 210/169 |
| 4,527,947 | A | 7/1985 | Elliott | 415/121 B |
| 4,560,476 | A | 12/1985 | Nishimori | 210/416.1 |
| 4,575,308 | A | 3/1986 | Corkill | 415/213 A |
| 4,640,666 | A | 2/1987 | Sodergard | 415/121 B |
| 4,697,746 | A | 10/1987 | Nishimori | 241/46 B |
| 4,778,336 | A | 10/1988 | Husain | 415/121 B |
| 4,842,479 | A | 6/1989 | Dorsch | 415/121.1 |
| 4,877,368 | A | 10/1989 | Timperi et al. | 415/143 |
| 5,302,082 | A | 4/1994 | Gilbert | 415/121.1 |
| 5,460,483 | A * | 10/1995 | Dorsch | 415/121.1 |
| 6,551,054 | B1 | 4/2003 | Peltonen et al. | 415/72 |
| 6,619,910 | B1 | 9/2003 | Burgess | 415/74 |

* cited by examiner

FIGURE 4
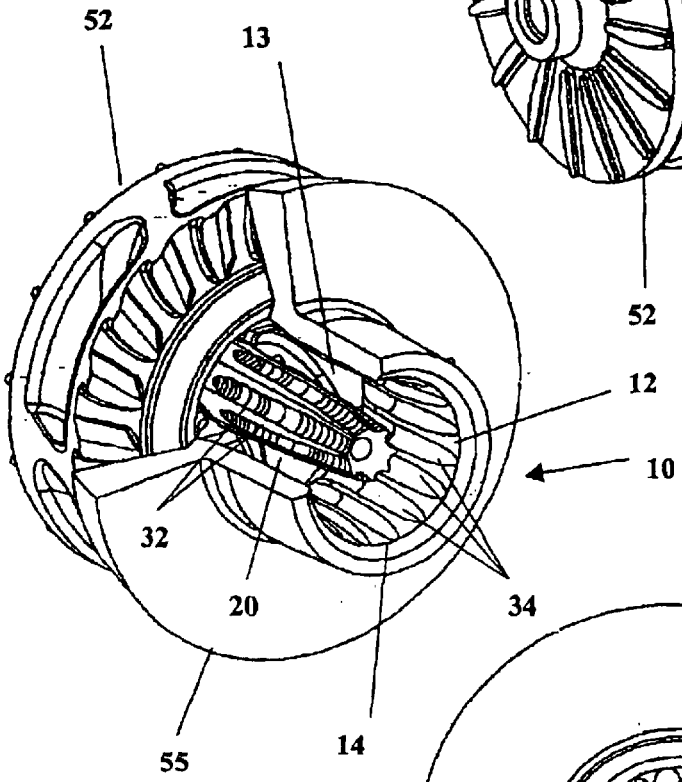
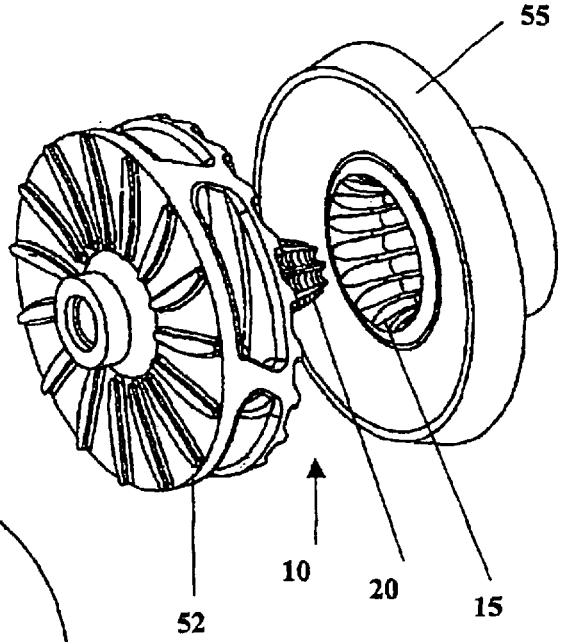
FIGURE 5
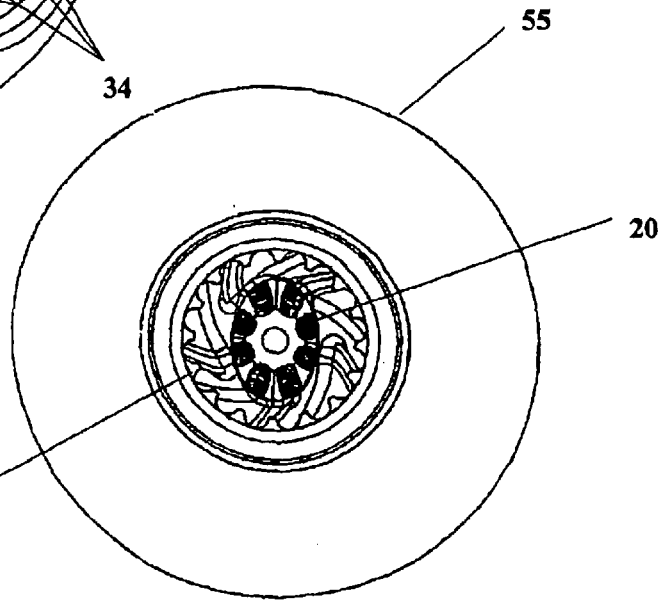
FIGURE 6

APPARATUS FOR USE IN SLURRY PUMPS

The present invention relates generally to apparatus suitable for use with pumps such as for example centrifugal pumps for use in the pumping of slurries. By the term "slurries" is meant any liquid containing solid materials.

In some applications the solid, particulate matter or scale particles in a slurry is of such a size that it can cause clogging or damage to the impeller of a centrifugal pump as the slurry passes therethrough.

An object of the present invention is to provide improved apparatus which alleviates the aforementioned problem.

According to one aspect of the present invention there is provided apparatus suitable for use with pumps, the apparatus including a stationary part which includes a processing chamber having an inner side wall and a central axis, an inlet and an outlet to and from the processing chamber and a rotatable part at least partially disposed within the processing chamber and including an outer wall which is spaced from the inner wall of the processing chamber.

Preferably, the rotating part is configured so that the space between the inner processing chamber wall and the outer wall of the rotating part varies. In one preferred form of the invention the rotating part is generally oval shaped when viewed in cross section although it will be appreciated that other suitable cross-sectional shapes could be utilised.

As mentioned earlier the apparatus of the present invention is suitable for use with pumps such as centrifugal pumps. A typical centrifugal pump includes a pump casing having an impeller therein, a pump inlet and a pump outlet.

In one preferred form of the invention the stationary part of the apparatus is operatively connected to or forms part of the pump inlet. For example, the stationary part may be in the form of a modified pump inlet component or throat bush of the pump.

Preferably the inner wall surface of the processing chamber is tapered inwardly in the direction of the central axis thereof from the inlet towards the outlet. In one preferred form the inner wall surface is generally frusto-conical in shape. It will be appreciated that alternatively or in addition to the outer wall of the rotating part may be inclined to provide for the tapering effect.

In one preferred form of the invention the rotatable part of the apparatus projects into the processing chamber through the outlet end thereof. The rotatable part may be in the form of a projection having a tapering nose portion. Preferably the projection forms part of the pump impeller.

The apparatus may further include an upstream connecting section which operatively connects the delivery pipe for the slurry to the stationary part. Preferably the connecting section includes a tapering chamber which tapers outwardly from the end of the delivery pipe to the stationary part. Preferably the cross-sectional dimension of the inlet to the processing chamber is about the same as the end of the connecting section adjacent thereto.

Grooves or recesses may be provided in the inner wall surface of the processing chamber and/or the outer wall surface of the rotatable part. Preferably the grooves or recesses are circumferentially spaced around the wall surfaces and can extend generally in the direction between the inlet and outlet of the processing chamber, or be curved relative to the axis.

The operation of a preferred embodiment of the apparatus according to this aspect of the present invention will hereafter be described. The slurry is delivered to the pump via a conventional delivery pipe or conduit where it enters the processing chamber of the stationary part of the apparatus via the inlet. The rotating part which in a preferred form forms part of the pump impeller is rotating within the chamber. The tapered inner wall of the chamber funnels the slurry towards the outlet of the chamber and into contact with the rotating part. The configuration of the rotatable part in combination with the tapered inner wall of the processing chamber causes large solids within the slurry to be broken down to a size where they can pass out of the outlet and enter and pass through the pump. The edges of the grooves or recess in the rotating part act as cutters on the solids in the slurry and cooperate with the grooves in the inner wall of the chamber to break down the solids in the slurry. The shape or contour of the rotating element has the effect of wedging and crashing the particles jammed between the stationary and rotating parts.

Preferred embodiments of the invention, will hereinafter be described with reference to the accompanying drawings embodiments are attached and in those drawings:

FIG. 4 is an exploded perspective view of apparatus according to the preferred embodiment of the present invention;

FIG. 5 is a partially and array perspective view of the apparatus shown in FIG. 4; and FIG. 6 is a front elevation of the apparatus shown in FIGS. 4 and 5.

Figure 1:
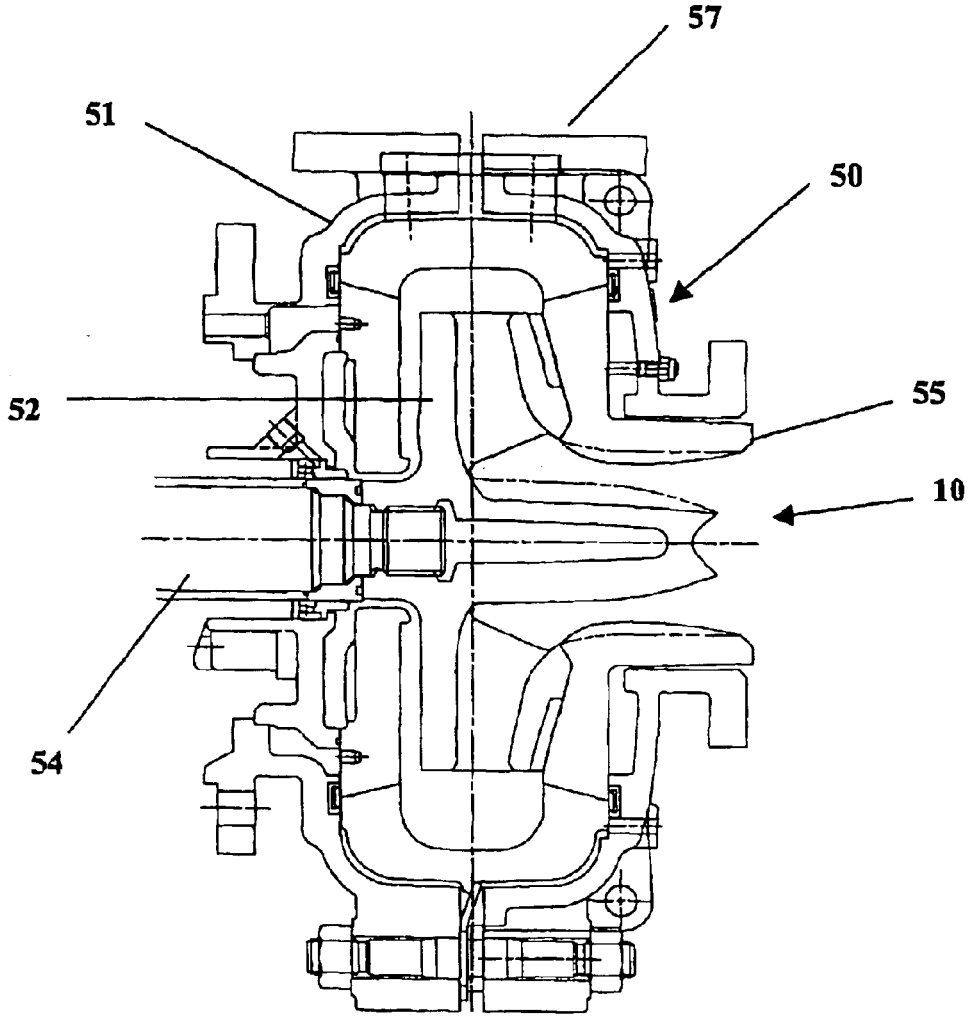
FIG. 1 is a schematic sectional side elevation as a pump having apparatus according to a preferred embodiment of the invention associated therewith.

Referring to FIG. 1 of the drawings there is shown a pump 50 having a pump casing 51, an impeller 52 disposed within the pump casing 51, the impeller 52 being operatively mounted to a drive shaft 54. The pump 50 further includes a pump inlet or throat bush 55 through wheel which slurry enters the pump casing 51 and a pump outlet 57. The apparatus 10 of the present invention forms part of the impeller 52 and throat bush 55 of the pump.

As best seen in FIGS. 2 to 5 there is shown apparatus generally indicated at 10 which includes a stationary part 12 having a processing chamber 13 therein which has an inner side wall 16, an inlet 14 and an outlet 15 and a rotatable part 20 which is at least partially disposed with the processing chamber 13 and includes an outer wall 21 which is spaced from the inner wall 16 of the processing chamber 13.

As best seen in FIG. 5 the rotating part 20 is generally oval in cross section. As a result the distance between the outer wall 21 of the rotating part 20 and the inner wall 16 of the stationary part varies.

Figure 2:
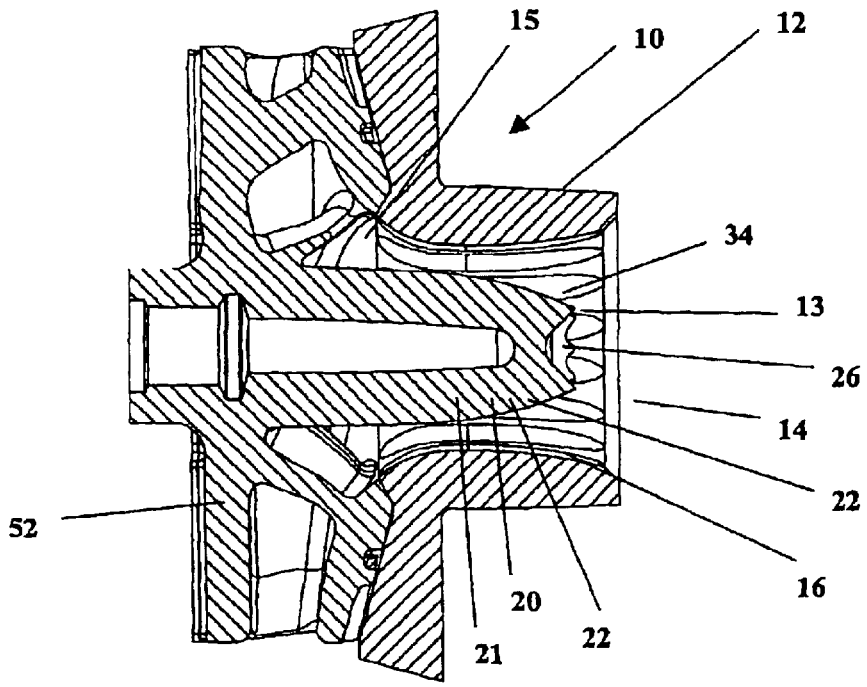
FIG. 2 is a schematic sectional side elevation of apparatus according to one form of the present invention.
Figure 3:
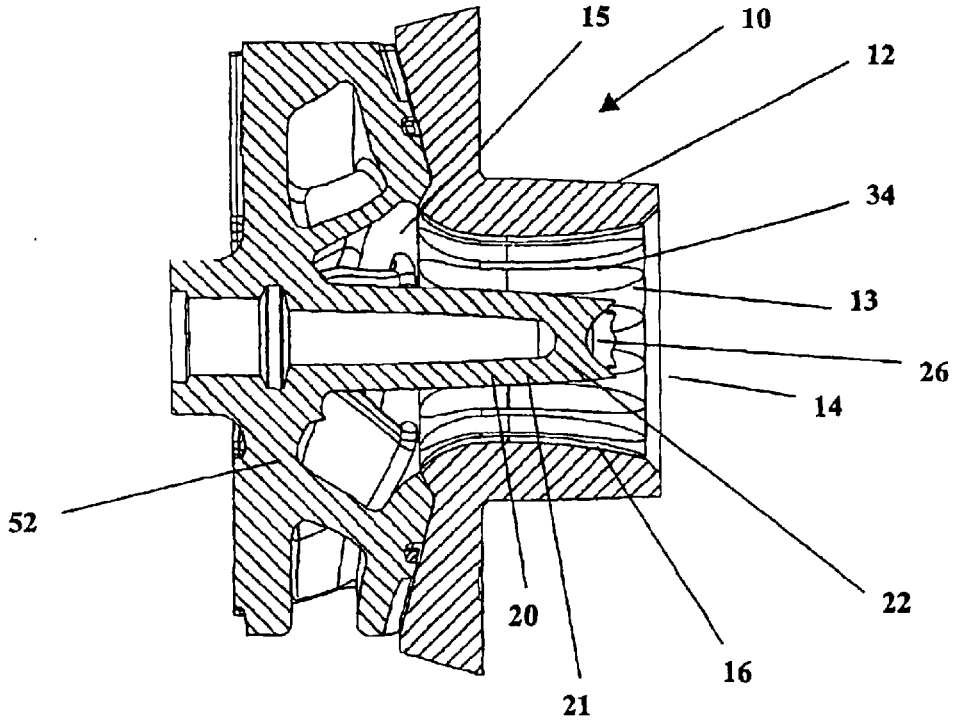
FIG. 3 is schematic side elevation of the apparatus show in FIG. 2 with the impeller reduced by 90°.

As best seen in FIGS. 2 and 3 the inner wall surface 16 of the processing chamber 13 is slightly tapered inwardly in the direction of the central axis thereof from the inlet 14 towards the outlet 15.

As shown the rotatable part 20 of the apparatus projects into the processing chamber 13 through the outlet end thereof. The rotatable part 20 is in the form of a projection 22 having a tapering nose portion 26. As shown the projection 22 forms part of the pump impeller 52.

The apparatus includes an upstream connecting section which operatively connects the delivery pipe for the slurry to the stationary part 12. The connecting section includes a tapering chamber which tapers outwardly from the end of the delivery pipe to the stationary part. The cross-sectional dimension of the inlet to the processing chamber is about the same as the end of the connecting section adjacent thereto.

Grooves or recesses 32 and 34 are provided in the inner wall surface of the processing chamber 13 and the outer wall surface of the rotatable part 20. The grooves or recesses 32 and 34 are circumferentially spaced around the wall surfaces and extend generally in the direction between the inlet and outlet of the processing chamber. The portions of each part between adjacent grooves or recesses form elements for breaking down, grinding or crushing which continue to act on the slurry being processed.

In operation slurry is delivered to the pump 50 via a conventional delivery pipe or conduit where it enters the processing chamber 13 of the stationary part 12 of the apparatus via the inlet 14. The rotating part 20 which forms part of the pump impeller 52 is rotating within the chamber 13. The tapered inner wall 16 of the chamber funnels the slurry towards the outlet 15 of the chamber and into contact with the rotating part. The configuration of the rotatable part in combination with the tapered inner wall of the processing chamber causes large solids within the slurry to be broken down to a size where they can pass out of the outlet and enter and pass through the pump. The edges of the grooves or recesses in the rotating part act as cutters on the solids in the slurry and cooperate with the grooves in the inner wall of the chamber to break down the solids in the slurry. The shape or contour of the rotating element has the effect of wedging and crushing the particles jammed between the stationary and rotating parts.

Finally, it is to be understood that alterations, modifications and/or additions may be incorporated into the various constructions and arrangements of parts without departing from the spirit or ambit of the invention.

The claims defining the invention are as follows:

1. Apparatus suitable for use with slurry pumps having a pump inlet, the apparatus when in use being disposed in the region of the pump inlet and including a stationary part which includes a processing chamber having an inner side wall and a central axis, an inlet and an outlet to and from the processing chamber and a rotatable part including a projection which is disposed within the processing chamber, the projection including an outer wall having a peripheral surface which is spaced from the inner wall of the processing chamber, the peripheral surface of the outer wall being generally oval shaped when viewed in cross-section along its length and configured so that the space between the inner processing chamber wall and the outer wall of the rotating part varies as the rotatable part rotates thereby providing for a crushing action on material within the processing chamber.

2. Apparatus according to claim 1 wherein the stationary part of the apparatus is operatively connected to or forms part of a pump inlet of the pump.

3. Apparatus according to claim 1 wherein the inner wall surface of the processing chamber is tapered inwardly in the direction of the ventral axis thereof from the inlet towards the outlet.

4. Apparatus according to claim 3 wherein the inner wall surface is generally frusto-conical in shape.

5. Apparatus according to claim 1 wherein the rotatable part of the apparatus projects into the processing chamber through the outlet end thereof.

6. Apparatus according to claim 5 wherein a projection has a tapering nose portion.

7. Apparatus according to claim 5 wherein the projection forms part of a pump impeller of the pump.

8. Apparatus according to claim 1 wherein the apparatus further includes an upstream connecting section which operatively connects a delivery pipe for the slurry to the stationary part.

9. Apparatus according to claim 8 wherein the connecting section includes a tapering chamber which tapers outwardly from the end of the delivery pipe to the stationary part.

10. Apparatus according to claim 9 wherein the cross-sectional dimension of the inlet to the processing chamber is about the same as the end of the connecting section adjacent thereto.

11. Apparatus according to claim 1 further including grooves or recesses in the inner wall surface of the processing chamber and/or the peripheral surface of the outer wall of the rotatable part.

12. Apparatus according to claim 11 wherein the grooves or recesses are circumferentially spaced around the wall surfaces and can extend generally in the direction between the inlet and outlet of the processing chamber, or be curved relative to the axis.

* * * * *